United States Patent [19]

Pfarrwaller

[11] 4,083,385

[45] Apr. 11, 1978

[54] COUPLING FOR SECURING A HEDDLE FRAME TO A DRIVE LIFTER

[75] Inventor: Erwin Pfarrwaller, Winterthur, Switzerland

[73] Assignee: Sulzer Brothers Limited, Winterthur, Switzerland

[21] Appl. No.: 752,091

[22] Filed: Dec. 20, 1976

[30] Foreign Application Priority Data

| | | |
|---|---|---|
| Dec. 24, 1975 | Switzerland | 16769/75 |
| Feb. 4, 1976 | Switzerland | 1352/76 |

[51] Int. Cl.[2] ..... D03C 13/00

[52] U.S. Cl. ..... 139/59; 139/91

[58] Field of Search ..... 139/57, 58, 82, 83, 139/88, 91

[56] References Cited

U.S. PATENT DOCUMENTS

| | | | |
|---|---|---|---|
| 1,143,458 | 2/1963 | Kaufmann | 139/92 |
| 2,645,251 | 7/1953 | Haenny | 139/92 |
| 3,169,555 | 2/1965 | Koyder et al. | 139/91 |
| 3,696,842 | 10/1972 | Pfarrwaller | 139/57 |
| 3,888,284 | 6/1975 | Tiernan | 139/82 |

*Primary Examiner*—Henry S. Jaudon

*Attorney, Agent, or Firm*—Kenyon & Kenyon, Reilly, Carr & Chapin

[57] ABSTRACT

The coupling has at least one coupling part secured to the heddle frame with a toothed driving element extending from the beam into an opening in the drive lifter to engage with a second toothed coupling part. Each coupling part within a drive lifter is spaced from a wall of the drive lifter to define a passage to receive a driving element.

6 Claims, 7 Drawing Figures

COUPLING FOR SECURING A HEDDLE FRAME TO A DRIVE LIFTER

This invention relates to a coupling for securing a heddle frame to a drive lifter. More particularly, this invention relates to a coupling for releaseably securing a heddle frame to a drive lifter of a shedding mechanism of a weaving machine.

Heretofore, it has been known to connect a heddle frame with drive lifters of a shedding mechanism of a weaving machine by installing a pair of block shaped members in the heddle frame and by providing the outer end of each lifter with a hook having fork-like jaws to receive one of the block-shaped members. In order to minimize wear between a heddle frame and the drive lifters it has also been known to utilize a coupling device having two holders secured within the heddle frame and two hooks on the drive lifters for mating engagement, for example, as described in U.S. Pat. No. 696,842 and counterpart Swiss Pat. No. 488,830. Further, as described in these patents, coupling devices have also been known wherein tubular coupling parts are enclosed in a box-section heddle frame beam to cooperate with hook coupling parts on the drive lifters. When the heddle frame is introduced into a weaving machine, the coupling parts on the drive lifters are first introduced into the heddle beam via an aperture and thereafter the heddle frame is moved transversely of the drive lifters so as to engage the coupling parts on the drive lifters with the coupling parts in the heddle beam. However, in such cases, the apertures in the heddle beams must be relatively large so as to accommodate the required movements. As a result, there is a corresponding reduction in cross section of the heddle beam. Further, the toothed coupling part takes up a relatively large amount of the beam cross section. As a consequence, it is impossible to dispose retaining members in the region taken up by the coupling part, for example, for securing heddle laths or intermediate struts along the beam length.

Accordingly, it is an object of the invention to provide a coupling which requires a minimum reduction of a heddle beam cross section.

It is another object of the invention to provide a coupling having parts which take up very little space while providing a reliable driving connection.

It is another object of the invention to provide a coupling for securing a heddle frame to the drive lifters of a shedding mechanism without hindering the positioning of other components lengthwise of the heddle frame.

Briefly, the invention provides a coupling for releaseably securing a heddle frame to a shedding mechanism for reciprocating the frame. The coupling includes one part which extends from the heddle frame and a second part which is recessed in the shedding mechanism such that the coupling part on the heddle frame is inserted into the shedding mechanism prior to coupling with the recessed part in mutual engagement.

The heddle frame has a transverse beam of predetermined cross-sectional width to which one coupling part is secured while the shedding mechanism has at least one vertically reciprocally mounted drive lifter in which the other coupling part is secured. In addition, the lifter has a pair of parallel walls to which the second coupling part is secured and a transverse wall to define an opening. In addition, this latter coupling part is spaced from the transverse wall of the lifter a predetermined distance in order to define a passage to receive a driving element of the coupling part which is secured to and extends from the beam. This driving element is of a transverse width less than the pedetermined distance between the other coupling part and the transverse wall of the lifter and is also of a thickness less than the width of the beam.

The driving element of each coupling part extends a distance from the heddle frame beam so as to fall within the range of movement of the associated drive lifter. Thus, the drive element can be introduced between the two wall parts of the drive lifter when the heddle frame is put in place.

It is to be noted that the arrangement of a coupling part which extends from a beam of a heddle frame is known e.g. as described in U.S. Pat. 3,888,284. In one known construction of this kind, a corresponding drive member is screwed by way of a forked end to the two outside surfaces of the heddle frame beam while the other end engages in an L-shaped recess in a drive lifter. However, a relatively expensive machine operation is necessary in order to fabricate such a recess. Still further, another disadvantage of the known construction is that the minimum spacing between the heddle frame is determined not only by the thickness of the heddle frame cross section but also by the corresponding and relatively large dimension of the drive member which engages around the heddle frame.

A particular advantage of the coupling according to the invention resides in that the coupling elements can be fabricated and engaged with one another in a relatively simple manner. Further, the heddle frame can be disposed very close together. The minimum spacing between the heddle frames is mainly determined by the relatively cross-sectional width of each heddle frame. As a result, the heddle frames can be received in a correspondingly small area of a weaving machine. Thus, the heddle frames can be placed closer together than previously or, for a given pitch, the heddle frames can be thicker than in constructions in which the coupling parts engage around the heddle frames.

In one embodiment, which requires little space, the heddle frame coupling part has a ledge-like or ridge-like retaining part which extends transversely of the driving element and is secured to the beam in parallel relation.

According to another feature wherein the heddle beam is hollow, for example, being of a boxed section, the retaining part is disposed within the hollow interior of the beam while the driving element extends through an aperture in the bottom of the beam.

Conveniently, so that the beam cross-sectional region adjacent the heddle lath may be left free for securing and/or possible movement of the retaining elements for intermediate struts and heddle laths, the retaining part has a dimension which is smaller than the hollow interior of the beam, as considered in the drive direction of the drive lifter and which is disposed in that cross-sectional region of the shaft beam which is near the drive lifter.

In order to provide a simple means of stiffening the beam cross section which has been reduced as a result of the aperture, the retaining part has two arms which extend beyond the aperture within the beam. Each of these arms is secured to the beam, for example by welding.

In order to facilitate introduction of the heddle frame into a weaving machine, the drive element has a bearing surface disposed outside the passage within the drive lifter for abutting and sliding on the coupling part within the drive lifter.

In order to provide a very compact system in a construction having a hollow section drive lifter, the coupling part within the drive lifter is basically constructed as a toothed coupling part with drive surfaces operative in both drive lifter directions and is disposed in an end of the drive lifter near the heddle beam. The drive lifter thus provides a cover giving protection, for example, against soiling for the coupling parts.

These and other objects and advantages of the invention will become more apparent from the following detailed description and appended claims taken in conjunction with the accompanying drawings in which:

Figure 1:
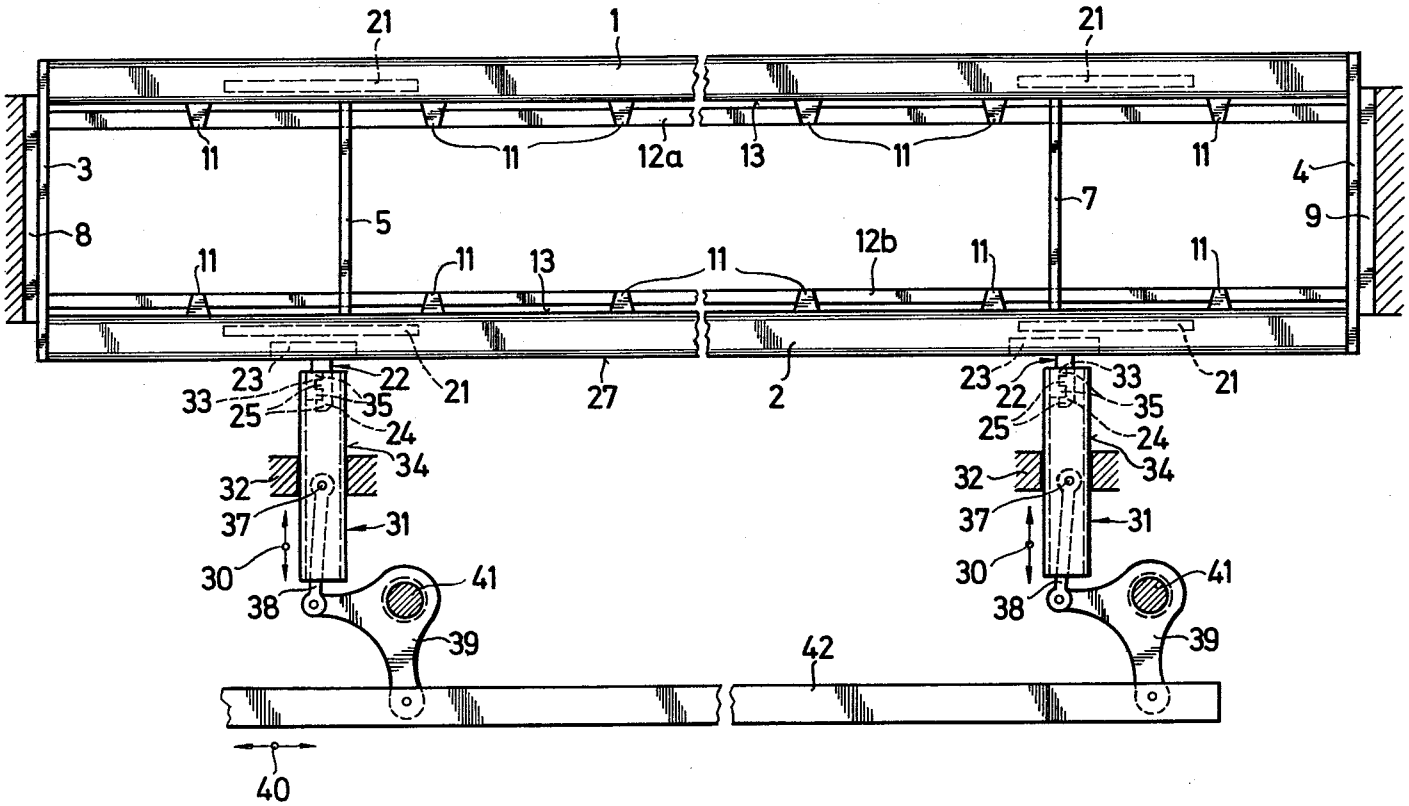
FIG. 1 illustrates a general representation of a heddle frame coupled to a pair of drive lifters according to the invention.

Referring to FIG. 1, a heddle frame comprises two shaft beams 1, 2 which are interconnected by two lateral struts or the like 3, 4. In addition, two intermediate struts 5, 7 are secured to the beams 1, 2 and serve to sub-divide the length of the heddle frame. The heddle frame is mounted via the lateral struts 3, 4 in lateral guides 8, 9 of a frame (not shown in greater detail) of a weaving machine so as to be reciprocated vertically. The guide 9 is mounted so as to be removable for purposes as described below.

The heddle frame also has a plurality of holders 11 secured to the respective beams 1, 2 to which heddle laths 12*a*, 12*b* are secured. Heddles (not shown) for guiding warp yarns of the weaving machine can be threaded onto the laths 12*a*, 12*b* in known manner.

Figure 3:
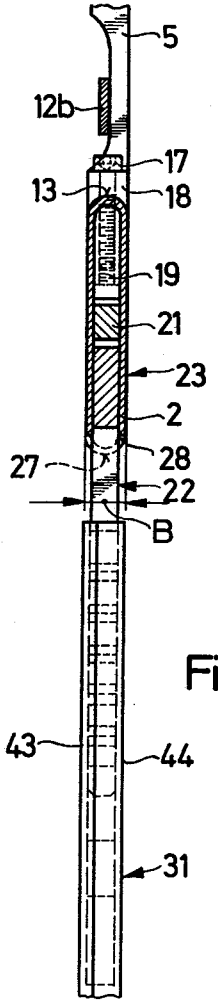
FIG. 3 illustrates a view taken on line III—III of FIG. 2.
Figure 2:
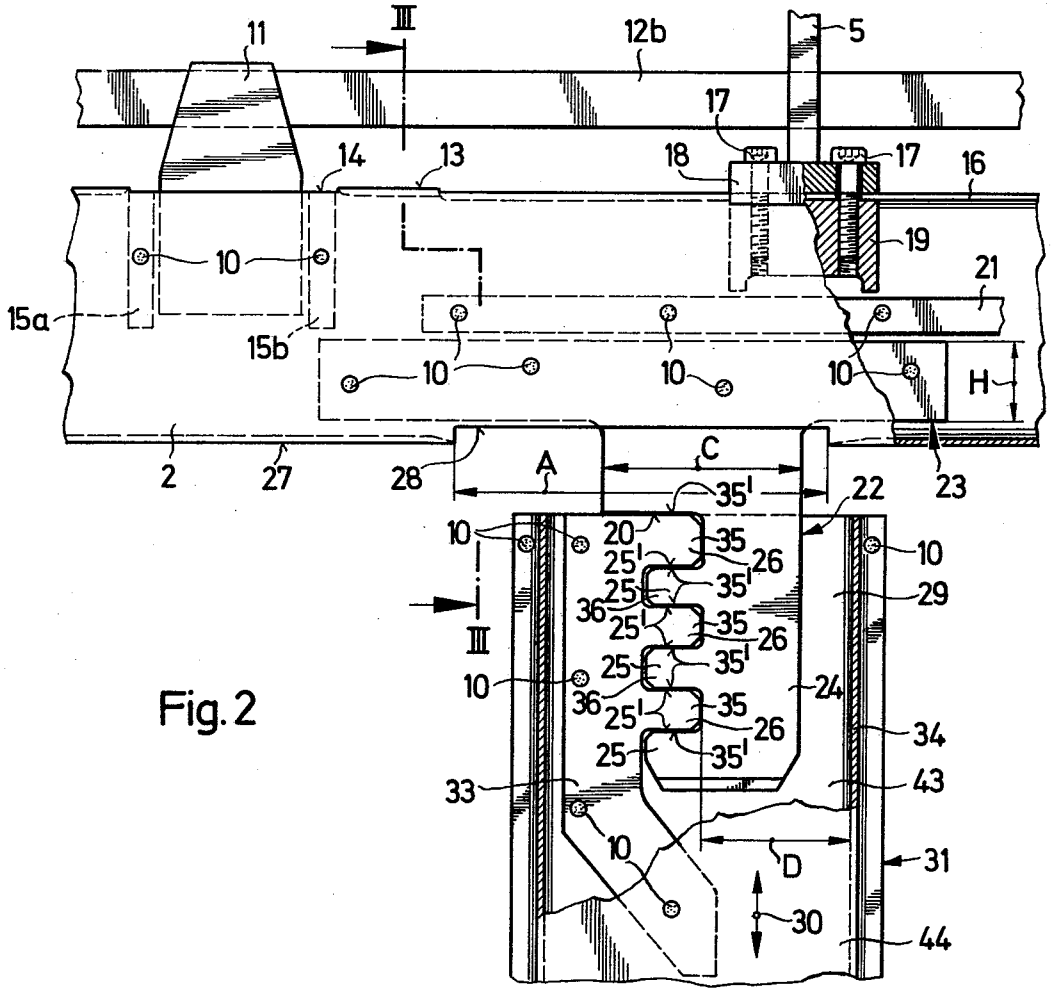
FIG. 2 illustrates an enlarged view of a coupling according to the invention.

Referring to FIG. 3, each beam 1, 2 is formed of hollow construction, for example in the form of a box member. As indicated in FIG. 2, each of the beams 1, 2 have narrow sides 13 which face one another and which are formed with recesses 14 from which the holders 11 project. Each holder 11 is secured to two retaining members 15*a*, 15*b* which are connected by spot welds 10 to the side walls of the shaft beam 1, 2 in known manner. The narrow sides 13 of the beams 1, 2 are formed with slots 16 in those longitudinal regions of the beam which are adapted to be associated with the intermediate struts 5, 7. The slots 16 are sized so as to permit passage of screws 17. As shown in FIGS. 2 and 3, the struts 5, 7 each have a bearing member 18 at each end which is adapted to the beam cross section and which can be placed on top of the narrow sides 13. The bearing member has suitable bores for passage of the screws 17 so as to permit threading of the screws 16 into a securing member 19 disposed in the hollow section beam 1, 2.

A strengthening ledge or ridge 21 is disposed near each slot 16 about half-way up the height of the hollow interior of the beam 1, 2. This strenghtening ledge 21 serves as an abutment for the securing elements 19 and is secured to the side walls of the beam by spot welds 10. As shown, the strengthening ledge 21 is longer than the associated slot 16.

Referring to FIG. 1, the heddle frame has a pair of substantially T-shaped coupling parts 22 secured to the bottom beam 2 below the ledges 21. Each coupling part 22 has a ledge-like or ridge-like retaining part 23 which can be introduced into the hollow interior of the beam 2 as well as a drive element which extends from and is perpendicular to the coupling retaining part 23. As viewed in FIG. 2, the driving element 24 has a toothed profile embodied by three teeth 25 and three teeth spaces 26. (The element 24 shown in FIG. 1 comprises two teeth and two tooth spaces.) The coupling part 23 is secured to the beam side walls by spot welds 10.

As shown in FIG. 2, the driving element 24 extends from the beam cross section through an aperture 28 in the bottom narrow side 27 of the beam 2. This aperture 28 is of a size and shape such that the part 23 can be introduced diagonally into the hollow interior of the beam. In this way, the aperture also serves as an assembly aperture for the retaining part 23. Preferably, the aperture 28 has a dimension A lengthwise of the beam 2 which is smaller than the length of the retaining part 23. Thus, the retaining part 23 has two arms which project from the aperture 28 on both sides. The spot welds 10 for these two arms are disposed out of the plane of the aperture 28. The dimension A of the aperture 28 is greater than the width C of the driving element 24 by the least possible amount which permits introduction of the retaining part 23.

The teeth 25 are formed on a set back portion of the driving element 24, which portion extends only over a portion of the dimension C. The top flank of the tooth space which is near the beam 2 merges into a bearing surface which extends over the remainder of the dimension C and projects beyond the tooth profile.

The shedding mechanism for reciprocating the heddle frame has at least one drive lifter 31, for example, two. Each of these drive lifters is of hollow construction and is adapted to move up and down in slideways 32 as indicated by arrows 30 (FIG. 1).

Referring to FIGS. 1 and 2, a stud-like, cleatlike or tooth coupling part 33 is disposed within the top end of each drive lifter 31. As shown in FIG. 2, the coupling part 33 has a toothed cross-section formed by three teeth 35 and three tooth spaces 36 (the corresponding cross-section of the element 33 in FIG. 1 has two teeth and one tooth space). Each drive lifter 31 has a pair of parallel walls 43, 44 and a transverse wall defining an opening 29 in the lifter 31. The coupling part 33 is connected by spot welds 10 to the side walls 43, 44 at a distance D from the transverse wall 34. This distance D is less than the width C of the driving element 24 but greater than the corresponding external dimension of the toothed part of the driving element 24. Thus, the passage 29 is of sufficient size to permit insertion or removal of the driving element 24 for meshing engagement with the coupling part 33.

Referring to FIG. 1, the shedding mechanism also includes a push rod 38 which is pivotally mounted on a pin 37 in the hollow interior of each drive lifter 31 and which is secured via a pin connection to one arm of a belt crank lever 39. Each of the two levers 39 is mounted on a respective pivot 41 on the machine frame with the second arm of each pivoted to a drive rod 42.

The drive rod 42 is movable in the direction indicated by the arrows 40.

Referring to FIG. 1, the coupling parts 22 are so disposed on the heddle shaft beam 2 in relation to the lateral strut 3 in accordance with the distances between the drive lifters 31 and the guide 8 that with guidance of the heddle frame on both sides, the coupling parts 22, 33 engage with one another via the overlapping tooth flanks 35, 35'.

When the heddle frame is introduced into a weaving machine, the guide 9 associated with the lateral strut 4 is removed and the heddle frame is moved downwardly as viewed in FIG. 1 toward the drive lifters 31 while being spaced from the guide 8. In this way, the toothed part of each driving element 24 passes into a corresponding passage 29 formed in the drive lifters 31 until the bearing surfaces 20 of each coupling part 24 is placed loosely on the coupling part 33. Thereafter, the heddle frame is moved to the left as viewed in FIG. 1 so as to engage the lateral strut 3 in the guide 8. At this time, the two flanks 25', 35' of the coupling parts 22, 33 are brought together to engage one within the other. Thereafter, the guide 9 is refitted to lock the heddle frame to the drive lifters 31.

Referring to FIG. 1, in operation, the drive rod 42 of the shedding mechanism is moved positively in the direction indicated by the arrows 40 by a shedding motion machine, for example, via a double cam. At the same time, the two drive lifters 31 move in the direction indicated by the arrows 30 so as to reciprocate the heddle frame vertically in the manner necessary for shedding.

Figure 5:
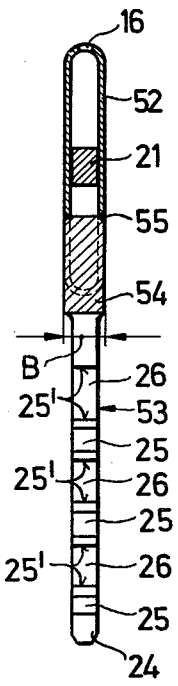
FIG. 5 illustrates a view taken on line V—V of FIG. 4.
Figure 4:
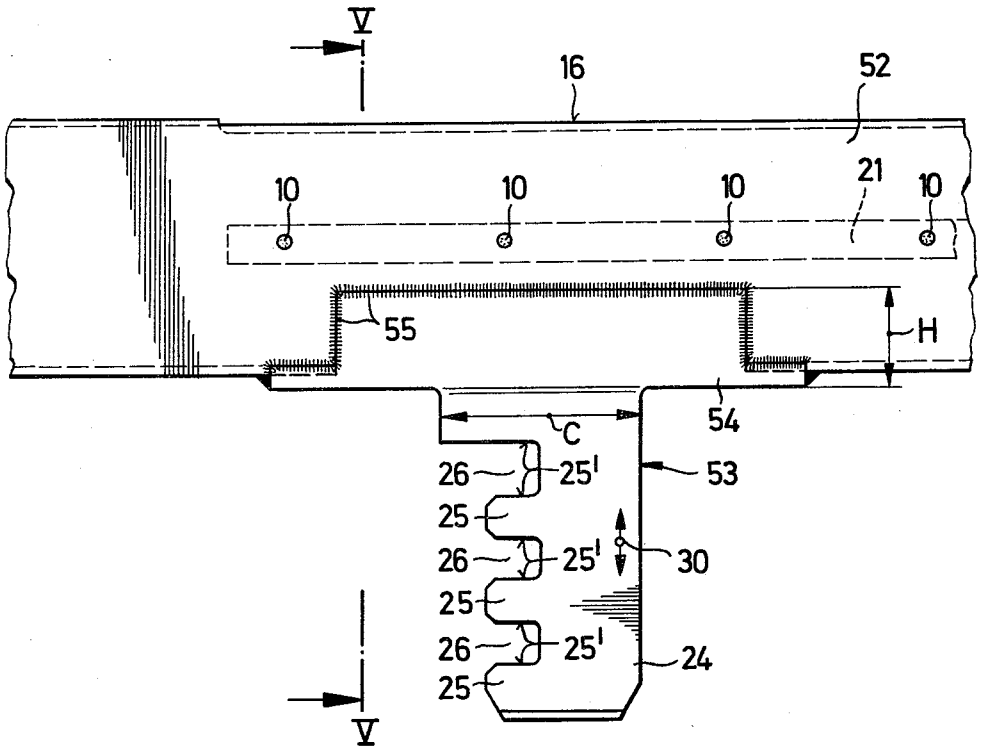
FIG. 4 illustrates a view of a modified coupling part on a heddle frame in accordance with the invention.

Referring to FIGS. 4 and 5 wherein like reference characters indicates like parts as above, the coupling may be modified so as to secure the driving element coupling part directly to the bottom of the heddle frame. To this end, the heddle frame beam 52 has a coupling part 53 which is secured thereto by way of a retaining part 54 within a recess 55 of the beam or in some other manner, for example by adhesives. Preferably, the retaining part 54 is of a size and shape so as to have substantially the same width as the corresponding external dimension B of the cross-section of the beam 52 as measured transversely of the drive direction (arrows 30) of the beam 52. In this embodiment, the bottom narrow side of the beam 52 is void of apertures which would reduce the beam cross-section. As a result, the construction of the beam 52 is simplified.

Figure 7:
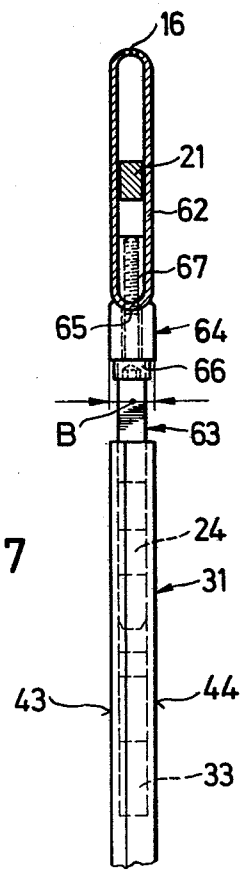
FIG. 7 illustrates a view taken on line VII—VII of FIG. 6.
Figure 6:
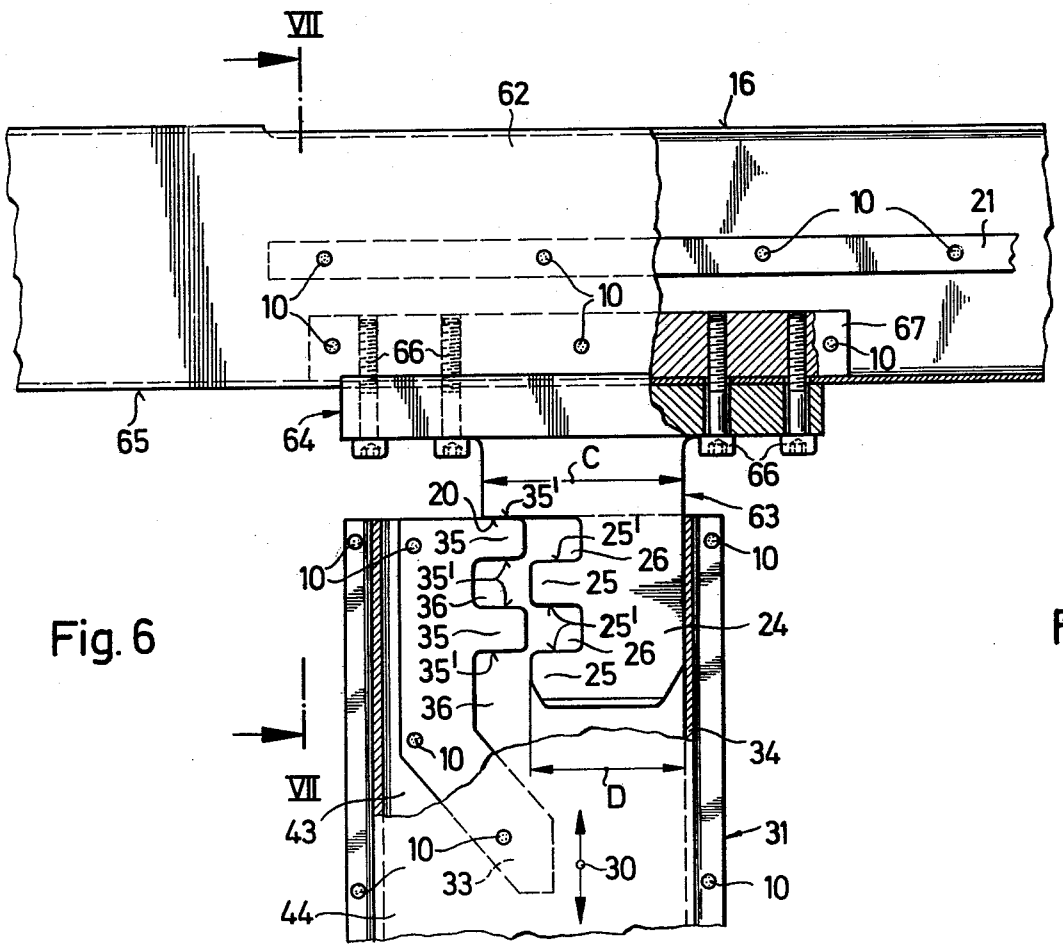
FIG. 6 illustrates a further modified coupling in accordance with the invention.

Referring to FIGS. 6 and 7, wherein like reference characters indicate like parts as above, the heddle frame beam 62 may be provided with a further modified coupling part 63. To this end, the coupling part 63 has a retaining part 54 which is substantially flush externally with the heddle frame beam side walls and which is secured by screws 66 to the bottom narrow sides 65 of the beam 62. These screws 66 connect the part 64 to a ledge or ridge 67 secured in the beam 62 by means of spot welds 10. The retaining part 64 can be secured to the narrow side 65 in some other way, such as by riveting, welding or by adhesives. Except for the virtually negligible holes for the screws 66, there is no cross-section reducing aperture in the bottom narrow side 65 of the shaft beam 62.

Referring to FIGS. 2 and 4, for the same dimenions H of the retaining parts 23, 54 and for the same cross-sections of the beams 2, 52, that proportion of the cross-sectional height of the beam 52 which is taken up by the part 54 is less, at least by the radius of curvature of the beam cross-sectional shape than that taken up by the retaining part 23 in the beam 2.

Referring to FIG. 1, instead of using two drive lifters, a different number of lifters can be provided, for example, five, depending upon the width of the weaving machine. Similarly, the heddle frame can have a number of intermediate struts which are, for example, disposed outside the coupling region or can be completely void of any intermediate struts.

A particular advantage of the construction according to the invention is that when a number of heddle frames are fitted into a weaving machine, the frames can be arranged very close together — substantially contiguously — without hinderance from the driving elements of the shedding motion drive. This is due to the fact that the width determined by the cross-sectional shape of each heddle shaft beam is usually adequate to receive the associated drive element.

What is claimed is:

1. A combination comprising a heddle frame including a transverse beam of predetermined cross-sectional width;

a shedding mechanism for reciprocating said frame, said mechanism having at least one vertically reciprocacally mounted drive lifter, said lifter having a pair of parallel walls and a transverse wall therebetween defining an opening in said lifter; and a coupling releasably securing said frame to said lifter, said coupling including a pair of coupling parts disposed in mutual engagement, one of said parts being secured to said beam and the other of said parts being secured within said opening of said lifter to said parallel walls and being spaced from said transverse wall a predetermined distance to define a passage, said one coupling part having a driving element extending from said beam into said opening of said lifter between said parallel walls and a ridge-like retaining part extending transversely of said driving element and secured to said beam in parallel relation, said driving element being of a transverse width less than said predetermined distance of said passage between said other coupling part and said transverse wall and being of a thickness less than said width of said beam.

2. A combination as set forth in claim 1 wherein said beam is hollow and includes an aperture in a bottom thereof and said retaining part is disposed within said beam with said driving element extending through said aperture.

3. A combination as set forth in claim 2 wherein said retaining part is of a height within said beam less than the height of the hollow interior of said beam.

4. A combination as set forth in claim 2 wherein said retaining part has two arms extending beyond said aperture, each said arm being secured to said beam.

5. A combination as set forth in claim 1 wherein said one coupling part has a bearing surface disposed outside said passage for abutting and sliding on said other coupling part.

6. A combination as set forth in claim 1 wherein said coupling parts are toothed and are disposed in meshing engagement, said other coupling part being disposed on an end of said lifter near said beam.

* * * * *

UNITED STATES PATENT AND TRADEMARK OFFICE

CERTIFICATE OF CORRECTION

PATENT NO. : 4,083,385

DATED : April 11, 1978

INVENTOR(S) : Erwin Pfarrwaller

It is certified that error appears in the above-identified patent and that said Letters Patent are hereby corrected as shown below:

Column 1, line 21 change "696,842" to --3,696,842--

Signed and Sealed this

*Third* Day of *October 1978*

[SEAL]

*Attest:*

RUTH C. MASON
*Attesting Officer*

DONALD W. BANNER
*Commissioner of Patents and Trademarks*